US007628683B2

(12) United States Patent
Hofmann et al.

(10) Patent No.: US 7,628,683 B2
(45) Date of Patent: Dec. 8, 2009

(54) HANDHELD POWER TOOL WITH A GUARD HOOD

(75) Inventors: Albrecht Hofmann, Steinenbronn (DE); Thomas Schomisch, Filderstadt (DE); Ralf Bocka, Nuremberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/608,070

(22) Filed: Dec. 7, 2006

(65) Prior Publication Data

US 2007/0155296 A1 Jul. 5, 2007

(30) Foreign Application Priority Data

Dec. 30, 2005 (DE) ..... 10 2005 063 017

(51) Int. Cl.
*B24B 55/10* (2006.01)
*B24B 23/00* (2006.01)

(52) U.S. Cl. ..... 451/456; 451/454

(58) Field of Classification Search ..... 451/359, 451/358, 451–456
See application file for complete search history.

(56) References Cited

U.S. PATENT DOCUMENTS 2,301,264 A * 11/1942 Emery ..... 451/358
4,060,940 A * 12/1977 DeWitt ..... 451/358
4,891,915 A * 1/1990 Yasuda ..... 451/359
6,878,050 B2 * 4/2005 Wendt et al. ..... 451/451
7,063,606 B2 * 6/2006 Stierle et al. ..... 451/359

FOREIGN PATENT DOCUMENTS

DE 295 13 331 12/1996
DE 199 46 364 3/2001
GB 2131861 * 6/1984 ..... 451/456

* cited by examiner

*Primary Examiner*—Robert Rose
(74) *Attorney, Agent, or Firm*—Michael J. Striker

(57) ABSTRACT

A handheld power tool has a housing, a rotating cutting tool having a clamping neck structurally connected to the housing, a guard hood that covers the cutting tool and has a guard hood part and a slip-on ring for receiving the guard hood releasably and adjustably on the clamping neck, the slip-on ring being connected to the guard hood part and having detent means for axially securing the slip-on ring to the clamping neck, and additional torsion-prevention means configured as a stop flange provided on the guard hood, the flange being provided in addition to the slip-on ring and connected to the guard hood part so that, in an installed state the stop flange is in contact with a component of the power tool that is structurally connected to the housing.

16 Claims, 2 Drawing Sheets

HANDHELD POWER TOOL WITH A GUARD HOOD

CROSS-REFERENCE TO A RELATED APPLICATION

The invention described and claimed hereinbelow is also described in German Patent Application DE 102005063017.0 filed on Dec. 30, 2005. This German Patent Application, whose subject matter is incorporated here by reference, provides the basis for a claim of priority of invention under 35 U.S.C. 119(a)-(d).

BACKGROUND OF THE INVENTION

The invention relates to a handheld power tool, having a rotating cutting tool and a guard hood, covering the cutting tool.

In German Utility Model DE 295 13 331 U1, a handheld right-angle power sander is described, having a guard hood that includes a slip-on ring, integrally connected to the guard hood plate, and for releasably and adjustably receiving the guard hood, this ring can be locked to a clamping neck structurally connected to the housing. Located on the inside of the slip-on ring are detent cams, which upon being axially slipped onto the clamping neck enter into engagement with a circumferential groove. After the slip-on ring is axially slipped on and after the detent engagement of the detent cams with the circumferential groove, the axial locking position on the clamping neck is attained by pivoting the guard hood. To prevent the guard hood from being inadvertently pivoted back out of the detent position into the release position, a torsion-prevention means is provided, comprising a detent lug on the housing that is in engagement with a set of teeth on the outside of the slip-on ring.

In general, in such right-angle sanders, care must be taken that the retention and guidance forces, which are exerted on the power tool by the user via the handles, also act on the connection between the slip-on ring of the guard hood and the clamping neck on the housing of the right-angle sander. Since the force introduction points, which are defined via the position of the handles, may be located relatively far away from the connection point between the guard hood and the housing of the right-angle sander, relatively high torques occur as the right-angle sander is being guided and these torques must be absorbed by the right-angle sander. In the least favorable case, strong resultant forces in the connection point between the guard hood and the housing of the right-angle sander can lead to an uncontrolled release of the guard hood.

SUMMARY OF THE INVENTION

The object of the invention is, with simple provisions, to further develop a handheld power tool, which includes a rotating cutting tool and a guard hood that covers the cutting tool, in such a way that the forces which act on the connection point between the housing of the power tool and the guard hood are minimized.

In keeping with these objects and with others which will become apparent hereinafter, one feature of the present invention resides, briefly stated, in a handheld power tool, comprising a housing; a rotating cutting tool having a clamping neck structurally connected to said housing; a guard hood that covers said cutting tool and has a guard hood part and a slip-on ring for receiving said guard hood part releasably and adjustably on said clamping neck, said slip-on ring being connected to said guard hood part and having detent means for axially securing said slip-on ring to said clamping neck; and additional torsion-prevention means configured as a stop flange provided on said guard hood, said flange being provided in addition to said slip-on ring and connected to said guard hood part so that, in an installed state said stop flange is in contact with a component of the power tool that is structurally connected to said housing.

In the power tool of the invention, the torsion-prevention means is embodied as a stop flange, located radially outside the slip-on ring and solidly connected to a component of the guard hood; in the installed state, this stop flange is in contact with a component, structurally connected to the housing, of the power tool. This stop flange has a dual function: First, the stop flange prevents an unintended pivoting motion of the guard hood out of its detent and working position back into the release position; the stop flange acts as a torsion-prevention means for the guard hood and assures that in the installed state the guard hood will not be mistakenly restored to its outset position and the guard hood cannot be released axially from the power tool or from the housing of the power tool.

Second, with the aid of the stop flange, additional bracing between the guard hood and a component on the power tool is attained, as a result of which bending moments, which can lead to high peak forces, particularly at the connection point between the guard hood and the housing of the power tool, as a result of eccentric guidance of the guard hood by the user, are reduced considerably. Because of the reduced moments and forces at the connection point, lesser wall thicknesses in the components are in principle sufficient, without threatening the stability and safety. Moreover, guard hoods and housings of the power tool can be made of lighter-weight materials, such as stable plastic.

In a practical feature, a supplementary handle should be fastened to the stop flange and is provided in addition to a first handle which is located on the housing of the power tool. The supplementary handle serves the purpose of securely guiding the power tool. Since the main handle and the supplementary handle are as a rule offset from one another relative to the direction of motion of the power tool, the torques that occur as the power tool is guided are at least partly transmitted from the guard hood to the housing of the power tool via the stop flange, and as a result the connection between the slip-on ring on the guard hood and the clamping neck on the housing of the power tool is relieved.

A bore is preferably made in the stop flange, by which bore in the installed state a fastening component for fastening the guard hood to the housing of the power tool is guided. This fastening component may be the supplementary handle. In a further advantageous feature, it is provided that the bore in the stop flange is in a line with a threaded bore on the housing of the power tool, so that the fastening component or supplementary handle can be guided through the bore on the stop flange and screwed into the threaded bore on the housing of the power tool. In this way, a safe and secure connection, secured against relative rotation, between the stop flange and the housing of the power tool, and thus an effective torsion-prevention means for the guard hood as well, are attained.

As an alternative to the supplementary handle, a screw can be passed through the bore of the stop flange and screwed into the threaded bore on the housing. In this case, the supplementary handle is indeed not screwed into the threaded bore; nevertheless, the supplementary handle is fastened to the stop flange—or as an alternative to some other point on the guard hood.

In a practical way, the guard hood is connected in form-locking fashion to the power tool on the order of a bayonet mount, with a combined axial and rotational motion. To that end, detent cams are located in a practical way on the inside of the slip-on ring and in the installed state engage an annular groove, extending all the way around, that is embodied on the clamping neck which is structurally connected to the housing. A guide carriage may also be provided on the guard hood; it rests on the working surface and distributes additional bracing forces over a large area over the working surface.

The power tool is in particular a right-angle power sander. However, other handheld power tools with a rotating cutting tool and a guard hood that covers the cutting tool can also be considered.

The stop flange as a torsion-prevention means is used in an especially advantageous way in right-angle power sanders with a guard hood and a guide carriage, since these elements, because of the contact with the workpiece, lead to strong forces on the connection of the hood. Moreover, in guard hoods with a guide carriage, rotatability of the guard hood relative to the right-angle power sander is unnecessary after installation, which argues for the use of the stop flange. The stop flange can also be used in right-angle power sanders whose guard hood is embodied as rotatable relative to the housing of the right-angle power sander, so that the user can adjust the hood optimally to his particular work; in this case, the stop in a practical way limits the rotary motion in one direction of rotation but optionally in both directions of rotation, and the stop is preferably easy to release, in order to restore the rotatability again.

Further advantages and practical features will become apparent from the ensuing description in conjunction with the drawings.

DESCRIPTION OF THE PREFERRED EMBODIMENTS

Figure 1:
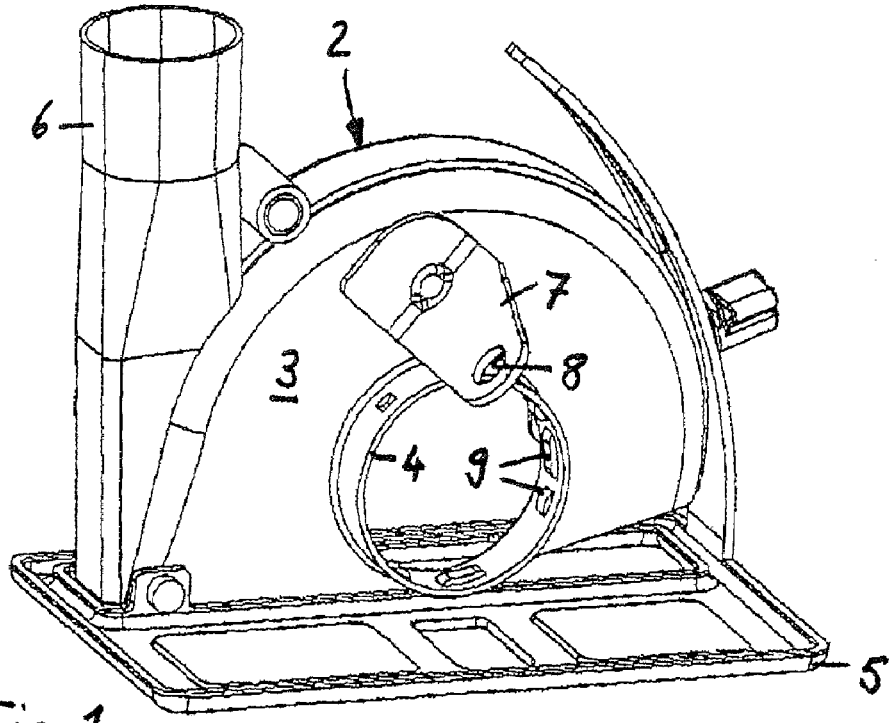
FIG. 1 is a perspective view of a guard hood for a handheld right-angle power sander, with a slip-on ring which is connected to the guard hood part, and with a stop flange above the slip-on ring, into which flange a bore is made for an additional connection between the guard hood and the housing of the power tool.

In the drawings, identical components are identified by the same reference numerals.

The guard hood 2 shown in FIG. 1 for a right-angle power sander includes a guard hood part 3, which in the installed state fits over the grinding wheel and into which a slip-on ring 4 has been inserted. The entire guard hood 2 is of metal, which is practical, but optionally a plastic version can also be considered. The slip-on ring 4 is advantageously embodied in one piece with the guard hood part 3 and on its inside has detent cams 9, which are distributed over the circumference and act as detent means for the secure locking of the guard hood 2 to the housing of the power tool.

The guard hood 2 furthermore includes a guide carriage 5, which is embodied as a separate component but is solidly connected to the guard hood part 3, and a connection stub 6 for a vacuum cleaner; the connection stub 6 may be embodied in one piece with the guard hood part 3. The slip-on ring 4 protrudes axially past a side face of the guard hood part 3. Directly above the slip-on ring 4- and spaced radially apart from the annular wall of the slip-on ring and located on the same side wall of the guard hood part, is a stop flange 7, which in the exemplary embodiment is embodied as a right-angle flange.

The stop flange 7 is secured with one of its legs to the side wall of the guard hood part 3; the other leg of the stop flange extends approximately perpendicular to the side wall of the guard hood part. A bore 8, which may be embodied either as a round hole or as an oblong hole, is made in the free, protruding end of the stop flange 7. In the installed state, the connection between the guard hood 2 and the right-angle power sander is made via the slip-on ring 4, which is slipped onto the drive spindle of the right-angle power sander and connected to a clamping neck on the right-angle power sander, and this connection is additionally made via the stop flange 7, which is connected to the housing of the right-angle power sander by means of a suitable fastening component.

Figure 2:
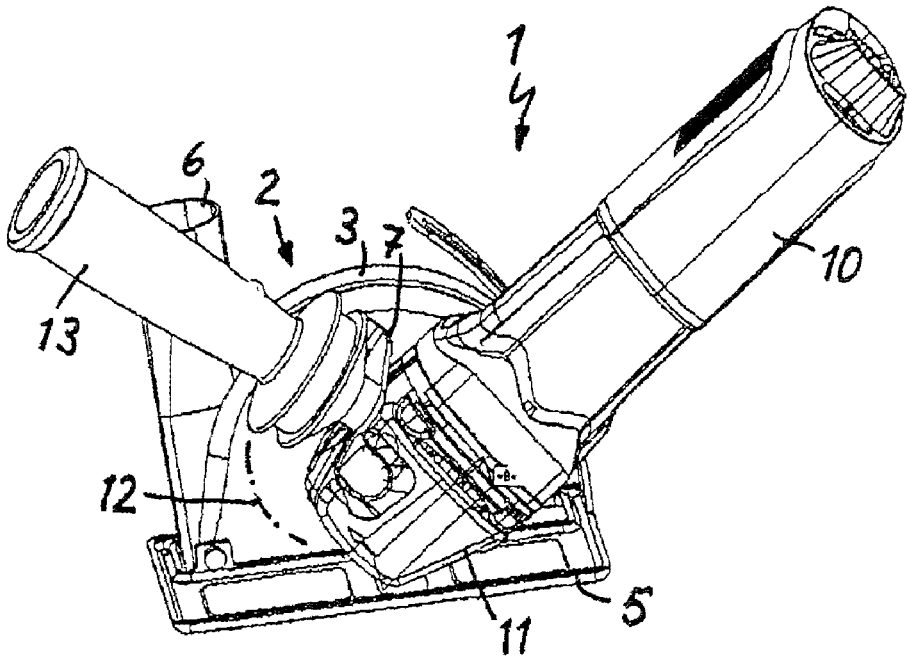
FIG. 2 shows the right-angle sander with the guard hood installed; a supplementary handle is guided through the bore in the stop flange and screwed into a threaded bore of the housing.
Figure 3:
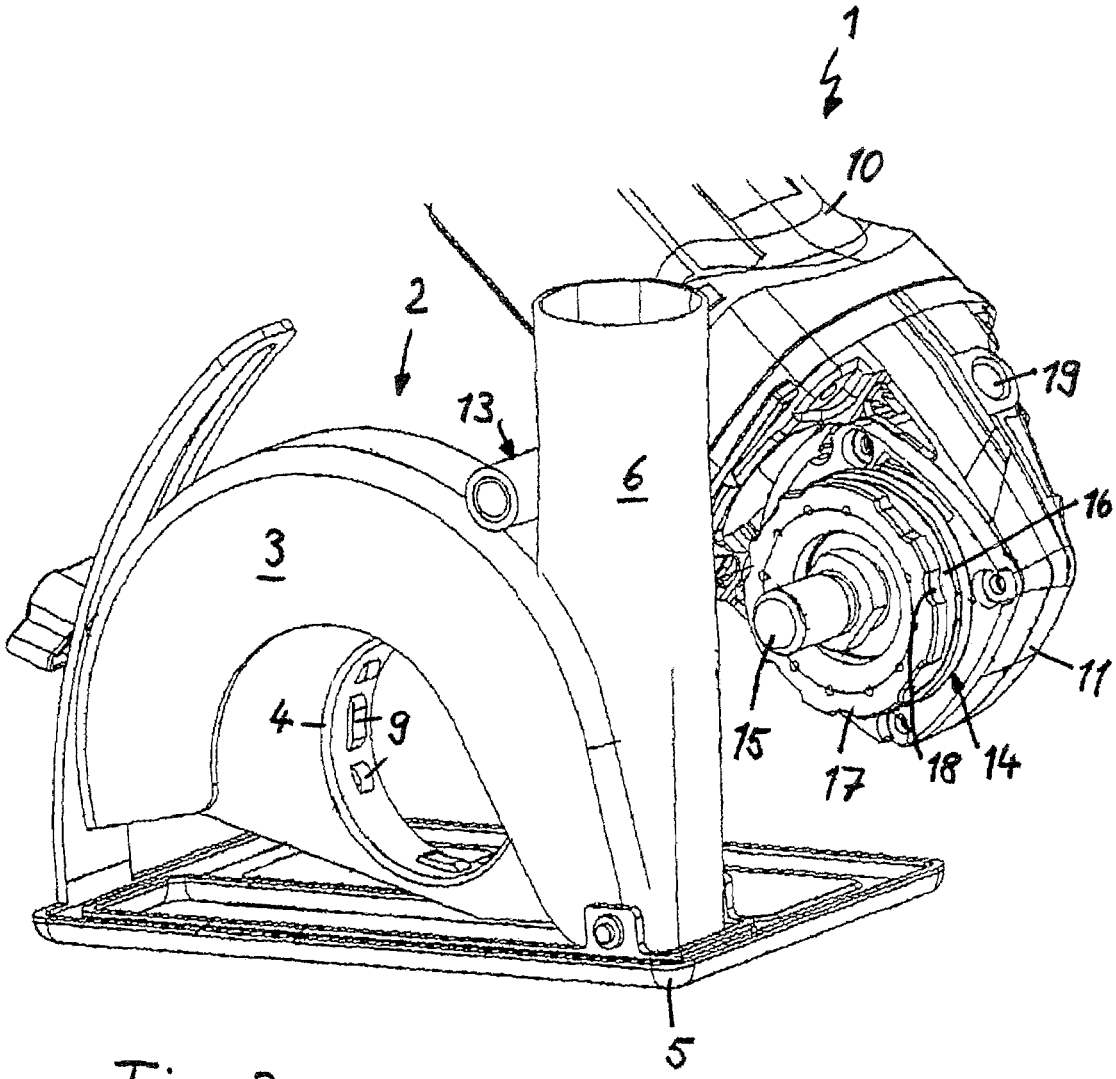
FIG. 3 shows the right-angle power sander and the guard hood in an exploded view from a different perspective.

The installed state is shown in FIG. 2. The electric motor of the right-angle power sander 1 is received in a motor housing 10, which is adjoined by a gearbox 11, in which the gear unit is accommodated. The grinding wheel 12 to be driven via the electric motor and the gear unit has the guard hood part 3 of the guard hood fitting over it in the installed state. In the installed state, the guard hood 2 is connected to the housing of the right-angle power sander in captive fashion, and the connection is embodied as a form-locking detent connection. For making the connection, the guard hood 2 is axially slipped with its slip-on ring 4 onto the clamping neck 14, which is a component of the gear unit on the right-angle power sander and is shown in FIG. 3. In the installed state, the drive spindle 15 for the grinding wheel protrudes through the slip-on ring 4.

An annular groove 16 extending all the way around is made in the clamping neck 14; on the side toward the guard hood 2 it is defined by a securing disk 17, which has recesses 18 at regular intervals on its circumference. These recesses 18 correspond with the detent cams 9 on the inside of the slip-on ring 4. For installing the guard hood 2, the slip-on ring 4 is axially thrust onto the clamping neck 14 in such a way that the detent cams 9 on the slip-on ring 4 are aligned with the recesses 18 on the outside of the securing disk 17. As soon as the detent cams 9 enter into engagement with the annular groove 16, extending all the way around and located behind the securing disk 17, the guard hood 2 can be pivoted into a position in which the detent cams 9 are out of with the recesses 18 on the securing disk 17, so that the guard hood 2 is retained in captive fashion on the housing of the right-angle power sander.

An additional fastening between the guard hood 2 and the gearbox 11 is effected via the stop flange 7, which is fastened to one side wall of the guard hood part 3, and via a supplementary handle 13, which is guided through the bore in the stop flange 7 and is additionally screwed into a threaded bore 19 that is made in the gearbox 11 on the right-angle power sander. Via the connection between the stop flange 7 and the gearbox 11, an inadvertent backward pivoting of the guard hood 2 into the release position, in which the guard hood could be removed axially from the housing of the right-angle power sander, is avoided. As a result, a torsion-prevention means for the guard hood 2 is attained, for one thing. For another, an additional bracing between the guard hood and the housing of the right-angle power sander is attained.

It will be understood that each of the elements described above, or two or more together, may also find a useful application in other types of constructions differing from the type described above.

While the invention has been illustrated and described as embodied in a handheld power tool with a guard hood, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A handheld power tool, comprising a housing; a rotating cutting tool having a clamping neck structurally connected to said housing; a guard hood that covers said cutting tool and has a guard hood part and a slip-on ring for receiving said guard hood part releasably and adjustably on said clamping neck, said slip-on ring being connected to said guard hood part and having detent means for axially securing said slip-on ring to said clamping neck; additional torsion-prevention means configured as a stop flange solidly connected to said guard hood, said stop flange being configured as a right-angle flange comprising a first leg and a second leg and which is provided in addition to said slip-on ring so that, in an installed state said stop flange is in contact with a component of the power tool that is structurally connected to said housing, wherein said stop flange of said torsion-prevention means is located radially outside said slip-on ring and is connected to said guard hood part; a supplementary handle which is fastened to said stop flange of said torsion-prevention means; a fastening component for fastening a housing, said stop flange having a bore through which in the installed state, said fastening component for fastening to said housing is guided, wherein the housing has a threaded bore; and the fastening component is formed by the supplementary handle and screwable into said threaded bore of said housing so that only one fastening component fastened to said stop flange and screwed into said housing is used to provide a connection between said guard hood and said housing.

2. A handheld power tool as defined in claim 1, wherein said bore in said stop flange is formed as an oblong bore.

3. A handheld power tool as defined in claim 1, wherein said housing has a threaded bore, said bore in said stop flange being aligned with said threaded bore in said housing.

4. A handheld power tool as defined in claim 1, wherein said housing has a threaded bore, said fastening component being configured as a screw which is screwable into said threaded bore of said housing.

5. A handheld power tool as defined in claim 1, wherein said clamping neck has an annular groove, said detent means being configured as detent cams which are located on an inside of said slip-on ring and in an installed state of the power tool engage said annular groove of said clamping neck.

6. A hand held power tool as defined in claim 1; and further comprising a guide carriage located on said guard hood.

7. A handheld power tool as defined in claim 6, wherein said guide carriage is fastened to said guard hood part; and further comprising means for fastening said guide carriage to said guard hood part.

8. A handheld power tool as defined in claim 1, wherein said power tool is configured as a right-angle power sander.

9. A handheld power tool as defined in claim 1, further comprising means for adjusting a depth-of-cut of the rotating cutting tool relative to a guide carriage, said means completing a twist fastener and an arc-shaped projection from the guide carriage, said means for adjusting a depth-of-cut being separate and distinct from the stop flange.

10. A handheld power tool as defined in claim 1, wherein the stop flange cannot rotate relative to the guard hood.

11. A handheld power tool as defined in claim 1, wherein the stop flange and housing can be fastened together in only one orientation.

12. A handheld power tool as defined in claim 1, wherein the supplementary handle itself rotates when it is screwed into said threaded bore.

13. A handheld power tool as defined in claim 1, wherein the supplementary handle is elongate so that it defines a long supplementary handle axis and said long supplementary handle axis intersects said housing.

14. A handheld power tool as defined in claim 1, wherein the supplementary handle is elongate so that is defines a long supplementary handle axis, said threaded bore is elongate so that it defines a threaded bore axis, and said long supplementary handle axis and said threaded bore axis are generally parallel.

15. A handheld power tool as defined in claim 1, wherein the guard hood part has a side wall, and the first leg is solidly connected to said guard hood part and the second leg extends approximately perpendicular to the side wall of the guard hood part.

16. A hand held power tool as defined in claim 1, wherein said supplementary handle is guided through the second leg.

* * * * *